US010502013B2

(12) United States Patent
Davis et al.

(10) Patent No.: US 10,502,013 B2
(45) Date of Patent: Dec. 10, 2019

(54) HYDRAULICALLY ACTIVATED SETTING TOOL AND METHOD

(71) Applicant: GEODYNAMICS, INC., Millsap, TX (US)

(72) Inventors: Robert Davis, Joshua, TX (US); Wayne Rosenthal, Weatherford, TX (US); Kevin George, Cleburne, TX (US); David Wesson, Fort Worth, TX (US); Michael Wroblicky, Millsap, TX (US); Jeremy Castaneda, Weatherford, TX (US)

(73) Assignee: GEODYNAMICS, INC., Millsap, TX (US)

( * ) Notice: Subject to any disclaimer, the term of this patent is extended or adjusted under 35 U.S.C. 154(b) by 0 days.

(21) Appl. No.: 16/193,030

(22) Filed: Nov. 16, 2018

(65) Prior Publication Data

US 2019/0242205 A1 Aug. 8, 2019

Related U.S. Application Data

(60) Provisional application No. 62/625,700, filed on Feb. 2, 2018.

(51) Int. Cl.

| | |
|---|---|
| ***E21B 23/00*** | (2006.01) |
| ***E21B 23/01*** | (2006.01) |
| ***E21B 23/06*** | (2006.01) |
| ***E21B 23/04*** | (2006.01) |

(52) U.S. Cl.

CPC ..... *E21B 23/04* (2013.01); *E21B 23/00* (2013.01); *E21B 23/06* (2013.01)

(58) Field of Classification Search

CPC .... E21B 23/04; E21B 23/06; E21B 2034/002; E21B 33/1295; E21B 34/063; E21B 41/00; E21B 43/117

See application file for complete search history.

(56) References Cited

U.S. PATENT DOCUMENTS

| | | | | |
|---|---|---|---|---|
| 4,796,699 | A * | 1/1989 | Upchurch | E21B 23/04 166/250.17 |
| 8,662,164 | B2 | 3/2014 | Watson | |
| 2007/0089911 | A1 * | 4/2007 | Moyes | E21B 4/02 175/93 |

(Continued)

OTHER PUBLICATIONS

International Search Report and Written Opinion, dated Jan. 25, 2019, from corresponding/related International Application No. PCT/US2018/61430.

*Primary Examiner* — Daniel P Stephenson

(74) *Attorney, Agent, or Firm* — Patent Portfolio Builders PLLC

(57) ABSTRACT

A hydraulically activated setting tool for setting an auxiliary tool in a well, the setting tool including a housing that prevents a well fluid from entering inside the housing; a floating piston placed inside the housing and closing an end of a pressure chamber; an attached piston placed inside the housing and configured to actuate the auxiliary tool; a fluid chamber located between the floating piston and the attached piston, wherein the fluid chamber holds a fluid; and a communication element configured to establish a fluid communication between an outside and an inside of the housing. The fluid communication makes a well fluid in the well to directly act on the floating piston.

29 Claims, 18 Drawing Sheets

(56) References Cited

U.S. PATENT DOCUMENTS

| | | | |
|---|---|---|---|
| 2009/0229832 | A1 | 9/2009 | King |
| 2011/0000669 | A1 | 1/2011 | Barlow et al. |
| 2011/0259607 | A1 | 10/2011 | Carisella |
| 2014/0076536 | A1 | 3/2014 | Doane |
| 2015/0315871 | A1 | 11/2015 | Fripp et al. |
| 2016/0108700 | A1 | 4/2016 | Halfmann et al. |
| 2018/0010619 | A1 | 1/2018 | Jaaskelainen |

* cited by examiner

HYDRAULICALLY ACTIVATED SETTING TOOL AND METHOD

BACKGROUND

Technical Field

Embodiments of the subject matter disclosed herein generally relate to downhole tools for well operations, and more specifically, to a hydraulically actuated, self-bleeding, setting tool used in a well for actuating an auxiliary tool.

Discussion of the Background

During well exploration, various tools are lowered into the well and placed at desired positions for drilling, plugging, perforating, or fracturing well. These tools are placed inside the well with the help of a conduit, as a wireline, electric line, continuous coiled tubing, threaded work string, etc. However, these tools need to be activated or set in place. The force needed to activate such a tool is large, for example, in excess of 20,000 to 30,000 lbs. Such a large force cannot be supplied by the conduit noted above.

A setting tool is commonly used in the industry to activate the tools noted above. Such a setting tool is typically activated by a powder that is burned quickly and generates a high pressurized gas that causes a piston to be driven inside the setting tool. The movement of this piston is used for activating the various auxiliary tools. A traditional setting tool 100 is shown in FIG. 1 and includes a firing head 102 that is connected to a pressure chamber 104. The firing head 102 ignites a primary igniter 103 that in turn ignites a power charge 106 located in the pressure chamber. Note that a secondary igniter may be located between the primary igniter and the power charge to bolster the igniting effect of the primary igniter.

A cylinder 110 is connected to a housing of the pressure chamber 104 and this cylinder fluidly communicates with the pressure chamber. Thus, when the power charge 106 burns, the large pressure generated inside the pressure chamber 104 is guided into the cylinder 110. A floating piston 112, which is located inside the cylinder 110, is pushed by the pressure formed in the pressure chamber 104 to the right in the figure. Oil 114, stored in a first chamber 115 of the cylinder 110, is pushed through a connector 116, formed in a block 118, which is located inside the cylinder 110, to a second chamber 120. Another piston 122 is located in the second chamber 120 and under the pressure exerted by the oil 114, the piston 122 and a piston rod 124 exert a large force on a setting mandrel 128. Crosslink 126 is placed to close an end 130 of the cylinder. Note that cylinder 110 has the end 130 sealed with a cylinder head 132 that allows the piston rod 124 to move back and forth without being affected by the wellbore/formation pressure.

After the setting tool has set the auxiliary tool, it needs to be raised to the surface and be reset for another use. Because the burning of the power charge 106 has created a large pressure inside the pressure chamber 104, this pressure needs to be relieved, the pressure chamber needs to be cleaned from the residual explosive and ashes, and the pistons and the oil (hydraulic fluids) need to be returned to their initial positions so that the setting tool can be used again.

Relieving the high pressure formed in the pressure chamber 104 is not only dangerous to the health of the workers performing this task, because of the toxic gases left behind by the burning of the power charge, but is also a safety issue because the pressure in the pressure chamber is high enough to injure the workers if its release is not carefully controlled. In this regard, note that the traditional setting tool 100 has a release valve 140 that is used for releasing the pressure from inside the pressure chamber. However, when the release valve 140 is removed from cylinder 100, due to the high pressure inside the cylinder, the release valve may behave like a projectile and injure the person removing it. For this reason, a dedicated removing procedure has been put in place and also a safety sleeve is used to cover the release valve, when at the surface, for relieving the pressure from the setting tool.

In addition, the burning of the power charge 106 generates residue that coats the interior of the pressure chamber 104. Thus, when the setting tool is brought to the surface, not only that the high pressure formed in the pressure chamber has to be relieved, but the interior of the pressure chamber needs to be cleaned for the next use. This process is very time intensive.

Therefore, the traditional procedure for releasing the high pressure from the pressure chamber and cleaning the pressure chamber is cumbersome, time consuming and dangerous. Thus, there is a need for a new setting tool that overcomes the above noted drawbacks.

SUMMARY

According to an embodiment, there is a hydraulically activated setting tool for setting an auxiliary tool in a well. The setting tool includes a housing that prevents a well fluid from entering inside the housing; a floating piston placed inside the housing and closing an end of a pressure chamber; an attached piston placed inside the housing and configured to actuate the auxiliary tool; a fluid chamber located between the floating piston and the attached piston, wherein the fluid chamber holds a fluid; and a communication element configured to establish a fluid communication between an outside and an inside of the housing. The fluid communication makes a well fluid in the well to directly act on the floating piston.

According to another embodiment, there is a method for manufacturing a setting tool for setting an auxiliary tool in a well. The method includes placing a floating piston in a housing to close an end of a pressure chamber, the housing being configured to prevent a well fluid from entering inside the pressure chamber; placing an attached piston in the housing, wherein the attached piston is configured to actuate the auxiliary tool; establishing a fluid chamber between the floating piston and the attached piston, wherein the fluid chamber holds a fluid; and placing a communication element inside the housing, the communication element being configured to establish a fluid communication between an outside and an inside of the housing.

According to still another embodiment, there is a method for setting an auxiliary tool in a well with a setting tool. The method includes attaching the setting tool to the auxiliary tool; lowering the setting tool and the auxiliary tool to a desired location inside the well; establishing fluid communication between the inside of the setting tool and an outside of the setting tool; and increasing a pressure of a well fluid to actuate the setting tool to set the auxiliary tool.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to a setting tool. However, the embodiments discussed herein are also applicable to any tool in which a high-pressure needs to be generated and then that high-pressure needs to be released outside the tool.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an embodiment, a hydraulically actuated setting tool has a floating piston and an attached piston. The floating piston, when actuated, pushes a fluid located inside the setting tool to actuate the attached piston. The floating piston is hydraulically actuated in this embodiment by a well fluid present in the well, outside the setting tool. A pressure of the well fluid is controlled, for example, with a pump at the head of the well, so that energy is transferred to the setting tool. The well fluid is allowed to enter the setting tool through various mechanisms, as now discussed.

Figure 1:
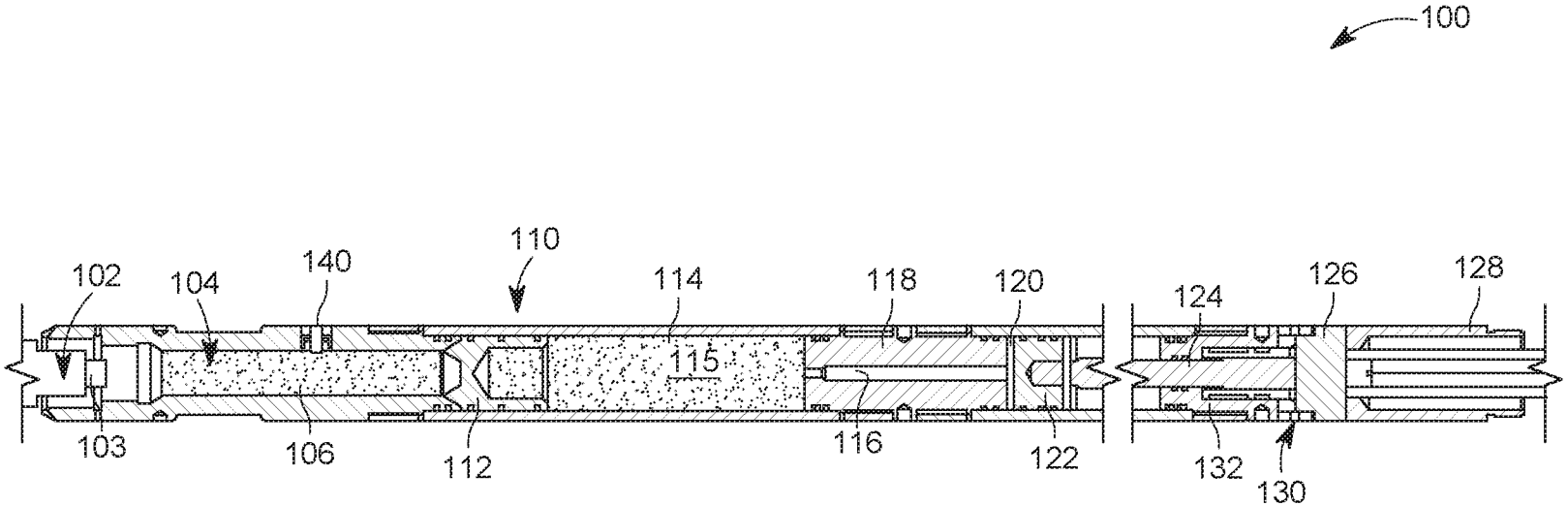
FIG. 1 (BACKGROUND ART)
FIG. 1 illustrates a traditional setting tool that needs to be retrieved to the surface for removing pressurized gas from inside.
Figure 2:
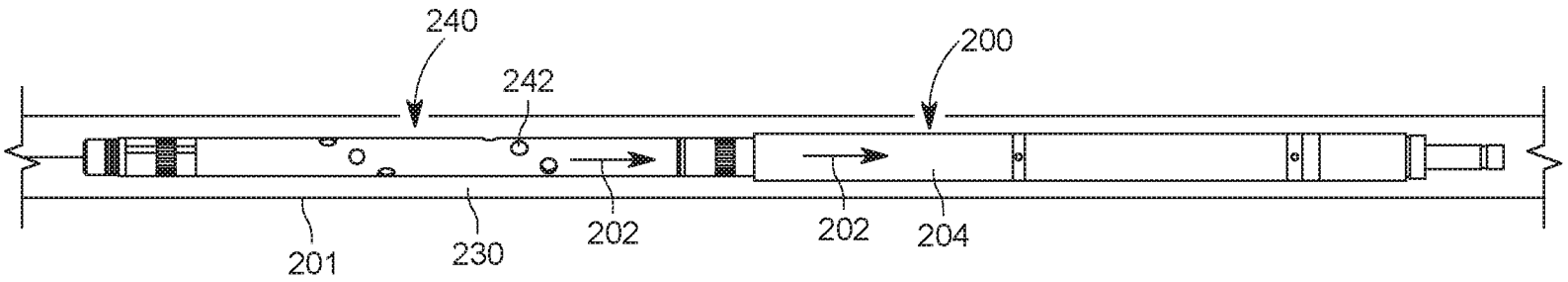
FIG. 2 shows a setting tool that is configured to use the well fluid for being actuated.

According to a first implementation of the hydraulically actuated setting tool, the well fluid is allowed to enter the setting tool through a gun string that is attached to the setting tool. More specifically, FIG. 2 shows a setting tool 200 that is directly attached to a gun string 240. Note that the existing setting tools 300 are connected, as shown schematically in FIG. 3, via a sub 320 and a quick change tool 322 to a gun string 340 and the sub 320 and the quick change tool 322 are designed to prevent a fluid communication between the gun string 340 and the setting tool 300. This means that even if the well fluid enters inside the casing of the gun string 340, after the shaped charges are fired, the well fluid cannot move into the setting tool.

Returning to FIG. 2, the well fluid 230, located in an annulus formed between the gun string 240 and the casing 201 of the well, is entering through the holes generated by the shaped charges 242, inside the gun string 240, and then it is entering inside the pressure chamber 204 of the setting tool 200, as illustrated by arrows 202.

Figure 4:
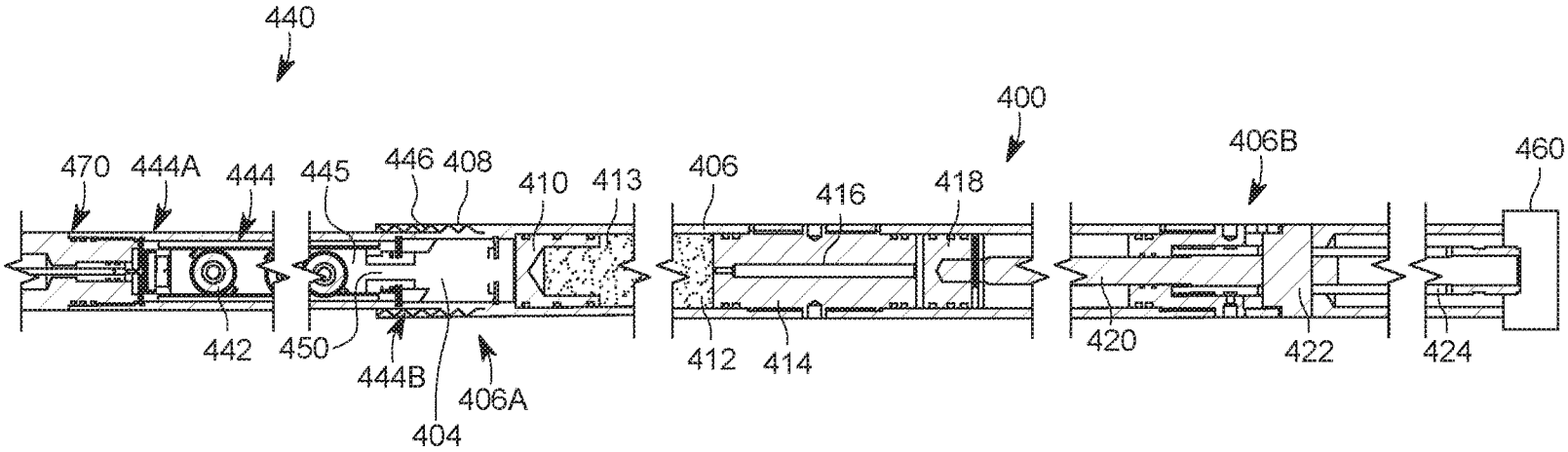
FIG. 4 shows a setting tool that directly connects to a gun string.

FIG. 4 shows in more detail the interior of the setting tool 400 and the gun string 440. Gun string 440 is shown in this figure having a casing 444 that is directly connected to a housing 406 of the setting tool 400. For example, threads 408 formed at a first end 406A of the setting tool 400 engage with corresponding threads 446 formed at a distal end 444B of the gun string 440. Note that casing 406 has the first end 406A (also called setting tool end) facing the gun string and a second end 406B facing the auxiliary tool 460 that needs to be set up. The first end 406A is also closer to the head of the well and the second end 406B is closer to the toe of the well. The gun string 440 has a proximal end 444A that is facing the head of the well and is connected to a sub 470 while the distal end 444B (also called the gun end) is facing the toe of the well. Casing 444 has an internal chamber 445 that houses the shaped charges and other elements.

FIG. 4 also shows a floating piston 410 that defines together with a block 414 a fluid chamber 412. Fluid chamber 412 holds a fluid 413 (for example, oil). The fluid chamber 412 is in fluid communication, through a fluid passage 416 formed in the block 414, with the attached piston (or second piston) 418. Piston 418 is attached through a rod 420 to a setting mandrel 424. Cross-link 422 closes the second end 406B of the housing 406. The setting mandrel 424 is connected to the auxiliary tool 460. The auxiliary tool 460 may be a frac-plug, a bridge plug, a retrievable plug, or other well bore tool that requires a setting tool.

A direct communication passage 450 is formed between the interior chamber 445 of the casing 444 of the gun string 440 and the pressure chamber 404 of the setting tool 400. In one application, the entire communication passage 450 is formed inside the gun string. In other application, part of the communication passage is formed in the gun string and another part is formed in the housing of the setting tool. When the gun string 440 and the setting tool 400 are assembled (i.e., connected to each other) at the head of the well, air at the atmospheric pressure is present inside the pressure chamber 404 and also inside the casing 444 (and interior chamber 445) of the gun string 440. Also, the interior of the pressure chamber 404 and the interior chamber 445 of the casing 444 are sealed from the outside when these two elements are connected to each other so that the well fluid cannot enter inside of either element. In other words, when the gun string 440 is not attached to the setting tool 400, the distal end 444B of the string gun is open to the ambient, similar to the first end 406A of the setting tool 400.

Figure 5:
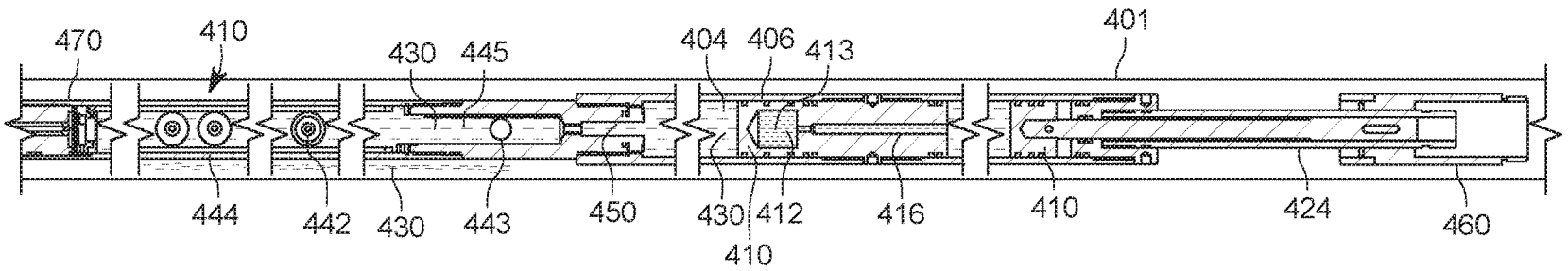
FIG. 5 shows the setting tool of FIG. 4 after the shaped charges of the gun string are fired.

When the assembled setting tool 400 and the gun string 440 are lowered inside the casing of the well, no well fluid can enter inside the interior chamber 445 and the pressure chamber 404, although the two chambers are in fluid communication through the communication passage 450. However, when the gun string 440 is shot as illustrated in FIG. 5, at least one of the shaped charges 442 has made a hole 443 through the casing 444 of the gun string 440, and the well fluid 430 from the well casing 401 now enters inside the interior chamber 445, defined by the casing 444. From here, the well fluid 430 enters through the communication passage 450 into the pressure chamber 404 and contacts the floating piston 410 in the setting tool 400.

If the operator of the well increases the pressure of the well fluid 430, the floating piston 410 is hydraulically actuated and it starts pushing the fluid 413, from inside the fluid chamber 412, through the fluid passage 416, which in turn actuates the attached piston 418. The attached piston 418 starts moving toward the auxiliary tool 460, actuating it with the setting mandrel 424. In this way, the movements of the floating piston, attached piston and the setting mandrel are achieved only due to the pressure increase of the well fluid inside the well, with no need of a detonation that is conventionally achieved with an igniter and power charge.

In this way, the amount of residue (e.g., sulfur, carbon and other harmful chemicals) inside the pressure chamber 404 is reduced as only the well fluid enters inside this chamber and the well fluid is mainly water and sand. This means, that when the setting tool is brought to the surface and prepared for a next use, the cleaning operation of the pressure chamber is much simplified comparative to the traditional methods. In addition, because the inside of the pressure chamber communicates freely with the well, due to the hole 443 made by one of the shaped charges 442, there is no residual high pressure confined in the pressure chamber when the setting tool is brought to the surface as the pressure inside the pressure chamber is the same to the pressure of the ambient of the setting tool.

Figure 6:
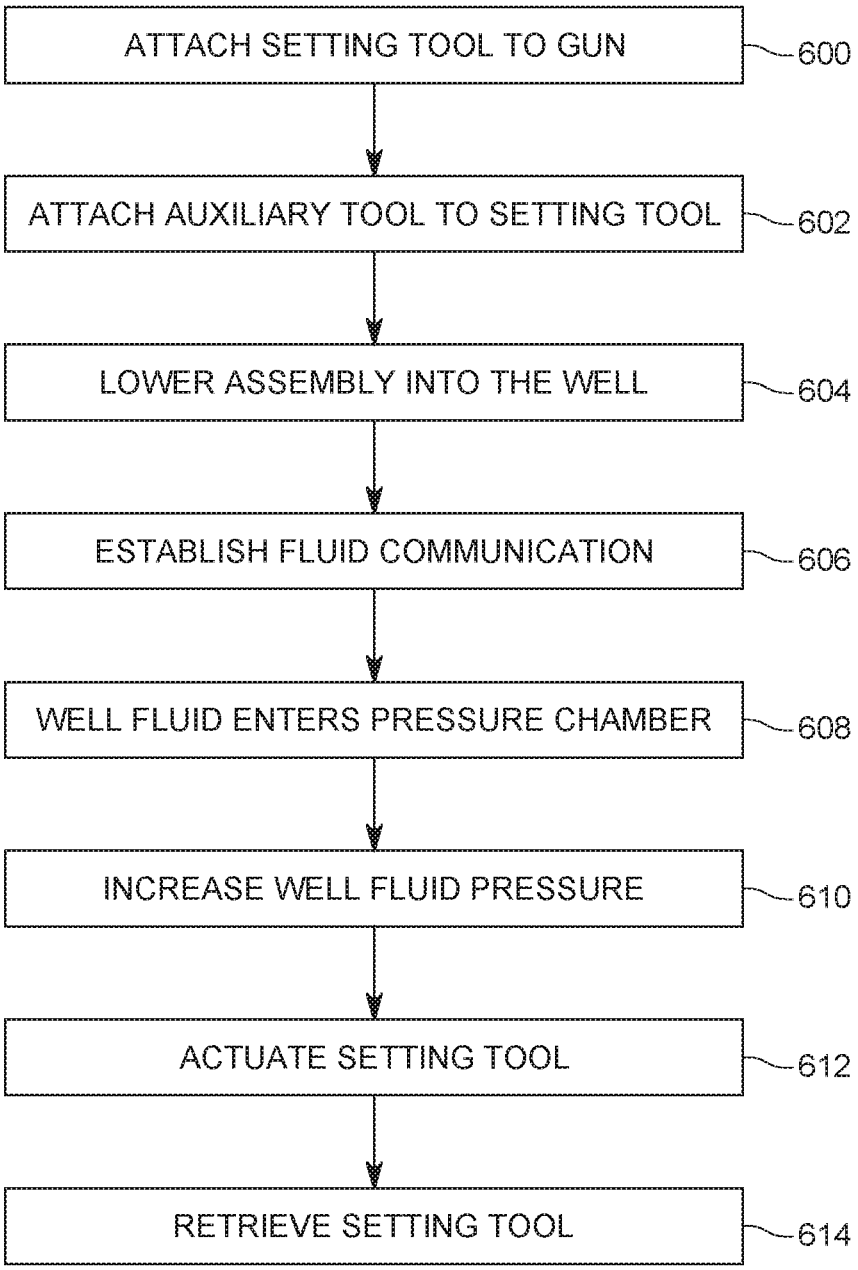
FIG. 6 is a flowchart of a method for using a setting tool that is actuated by a well fluid.

A method for using the setting tool 400 is now discussed with regard to FIG. 6. In step 600, the setting tool 400 is directly attached to the gun string 444. Note that in one application, no sub or quick change tool or any other device is used for attaching the setting tool to the gun string. An auxiliary tool 460 is then attached, in step 602, to the setting tool 400. The assembly 400, 444 is then lowered in step 604 into the well to a desired location. In step 606, a fluid communication is established between an outside of the setting tool and the pressure chamber 404 of the setting tool. This step may be implemented by firing the gun string as discussed above with regard to FIGS. 4 and 5, or by firing a single gun as discussed with regard to FIG. 7, or by firing a punch charge as discussed later, or by simply increasing a pressure in the well and breaking a disk in a wall of the gun or the setting tool, as also discussed later. Irrespective of the path taken for establishing the fluid communication between the outside of the assembly and the interior of the assembly, in step 608 the well fluid enters the pressure chamber of the setting tool and. In step 610, a pressure of the well fluid is increased from the surface by the operator to activate the setting tool and set the auxiliary tool in step 612. After the auxiliary tool is set, a mandrel of the setting tool, to which the auxiliary tool is attached, is configured to break away from the setting tool or from the auxiliary tool, so that in step 614 the setting tool can be retrieved to the surface while the auxiliary tool remains set inside the well. The setting tool is then cleaned and ready to be reused.

Figure 7:
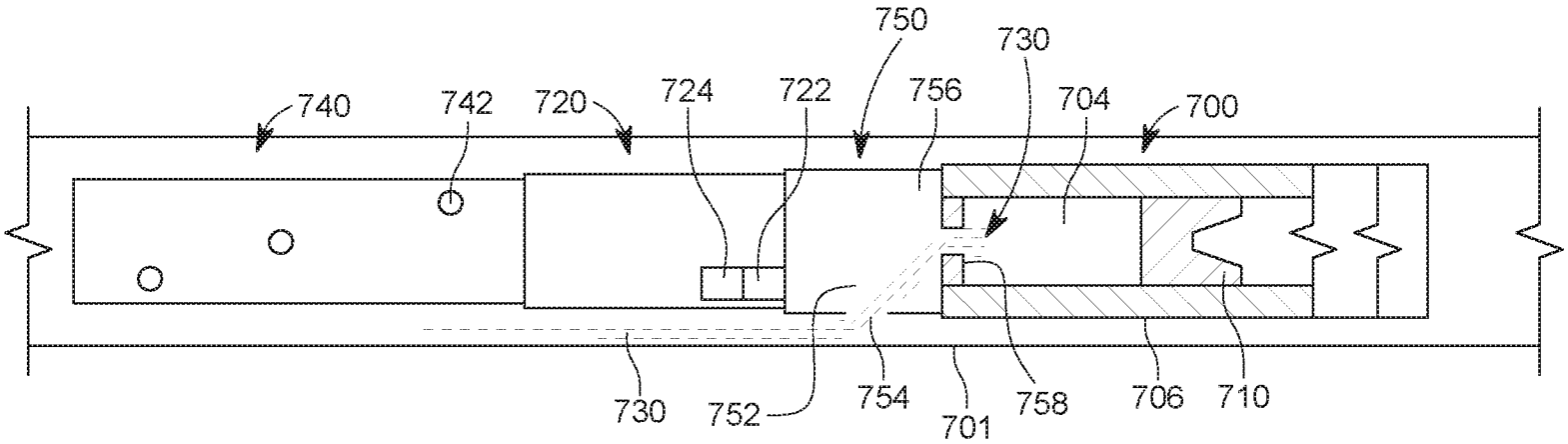
FIG. 7 shows a setting tool that connects to a single gun and is actuated by the well fluid.

According to another implementation of the hydraulically actuated setting tool, the well fluid is allowed to enter into the setting tool through a single (small) gun instead of a gun string as previously discussed. FIG. 7 shows an embodiment in which a gun string 740 is attached to a setting tool 700 through a sub 720 and a single gun 750. The single gun 750 has a punch charge 752 which is controlled by a detonator 722 located inside the sub 720. In one embodiment, the single gun 750 has a single punch charge and no other charges. A switch 724, also located inside the sub 740, is electrically controlled from the surface, and used to detonate the detonator so that the punch charge 752 is fired. The punch charge 752 is a small charge, smaller than a shaped charge 742 that can be found in a traditional gun string 740, so that when the punch charge 752 is fired, it is capable of making a hole 754 into the casing 756 of the single gun 750, but not through the casing 701. In this way, the well fluid 730 is capable of entering inside of the casing 756, which fluidly communicates through a communication passage 758 with a pressure chamber 704 of the housing 706 of the setting tool 700. The well fluid directly contacts floating piston 740 and actuates the setting tool as discussed in the previous embodiment.

Figure 8:
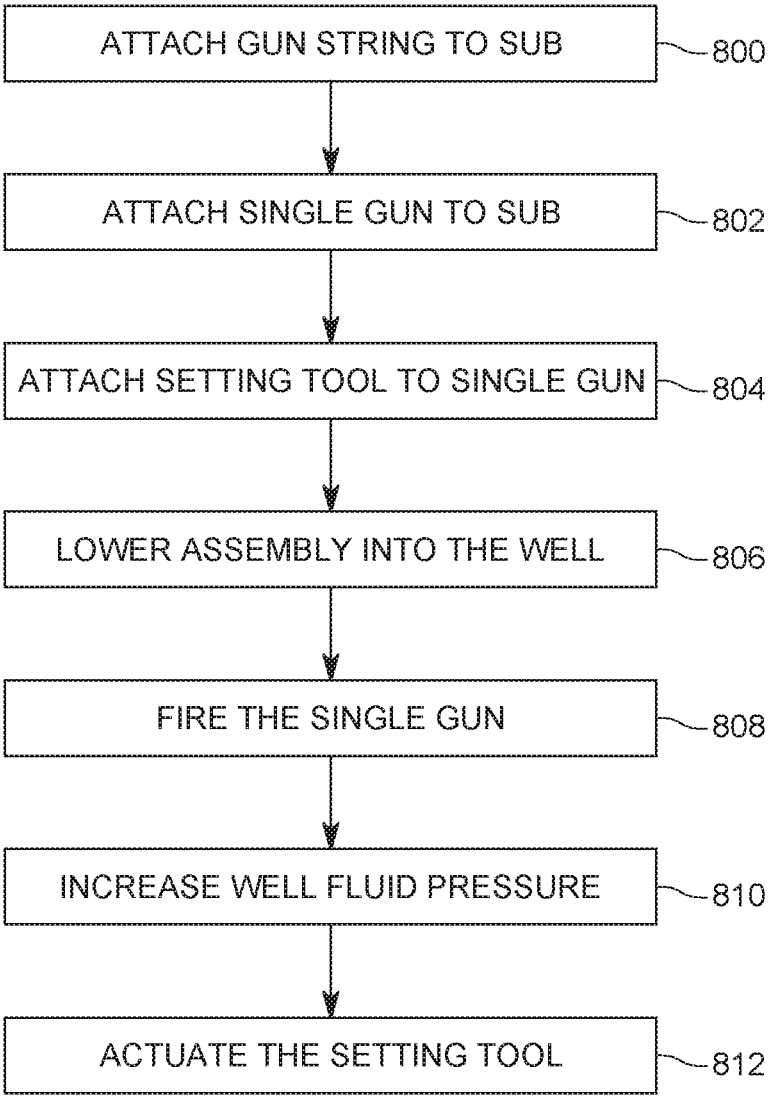
FIG. 8 is a flowchart of a method for using the single gun and the setting tool.

A method for actuating the setting tool 700 is now discussed with regard to FIG. 8. The method includes a step 800 of attaching a gun string 740 to a first end of a sub 720, a step 802 of attaching a single gun 750 directly to a second end of the sub 720, a step 804 of attaching the single gun 750 to the setting tool 700, a step 806 of lowering this assembly into a well, a step 808 of firing the single gun 750 to establish a fluid communication path between a well fluid and an inside of the single gun and the setting tool, a step 810 of increasing a pressure of the well fluid, and a step 812 of actuating the setting tool 700 by directly applying the pressure of the well fluid onto a floating piston 710.

Figure 9:
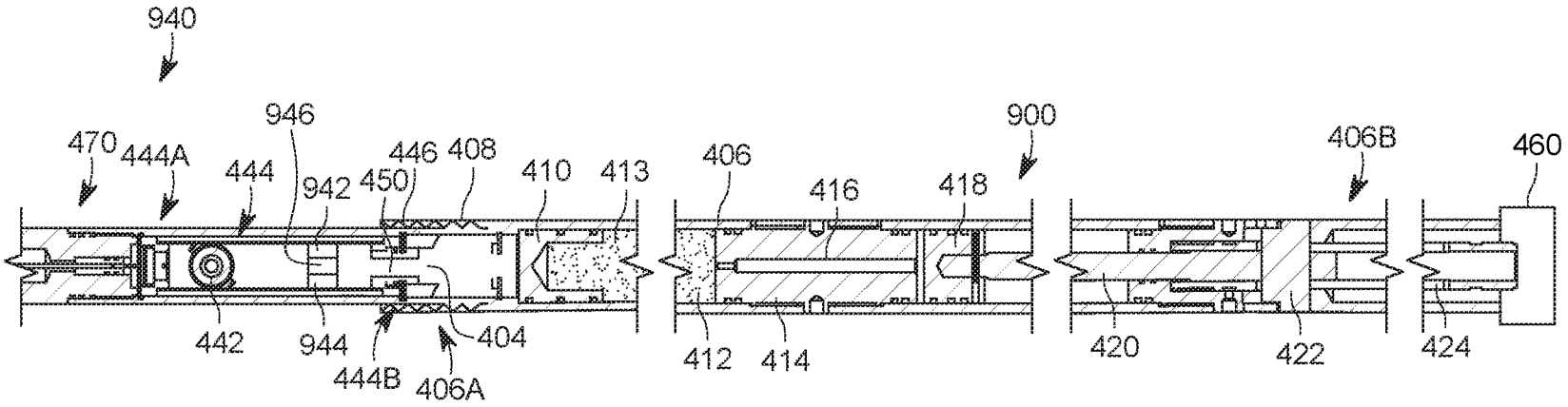
FIG. 9 shows a setting tool attached to a string gun and the string gun has a punch charge in addition to shaped charges.

According to still another implementation of the hydraulically actuated setting tool, as illustrated in FIG. 9, a setting tool 900 is directly attached to a string gun 940, similar to the configuration illustrated in FIG. 4. The difference from the configuration illustrated in FIG. 4 is that instead of using a shaped charge 442 for puncturing the casing 444 of the gun string 440, in this embodiment, a punch charge 942 is used to make a hole only through the casing 444 of the gun string, and not through the casing of the well. In addition, the punch charge 942 is wired separately and independently from the shaped charges 442 of the gun string. A switch 944 is used to ignite a detonator 946, which fires the punch charge 942. One skilled in the art would understand that the switch 944 and detonator 946 may also be located in a sub (not shown) located between the gun string 940 and the setting tool 900.

Figure 10:
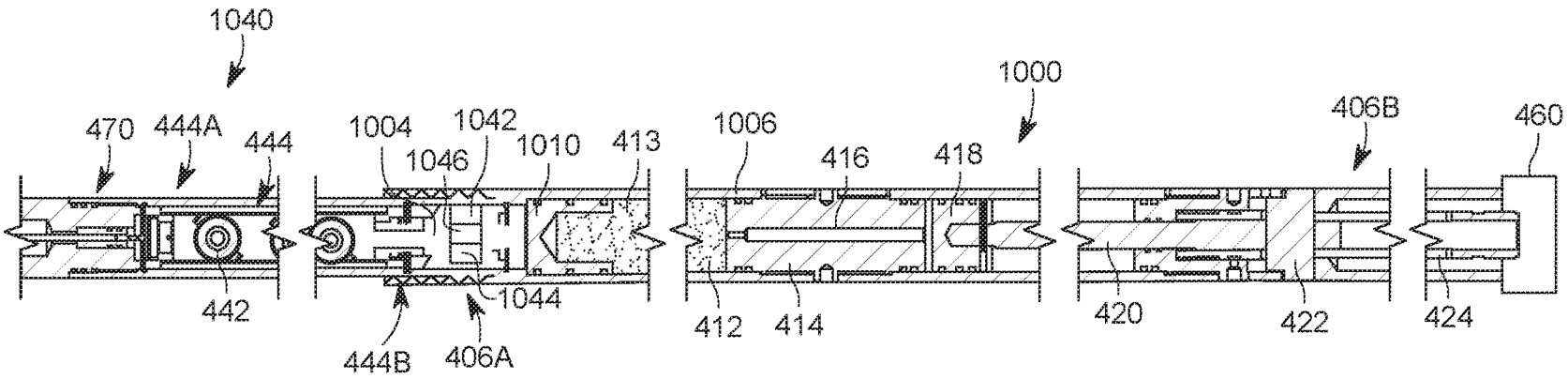
FIG. 10 shows a setting tool that includes a punch charge for perforating a housing of the setting tool.

In still another embodiment, a punch charge 1042 may be located directly in the pressure chamber 1004 of the setting tool 1000, as illustrated in FIG. 10. A switch 1044 may be also located inside pressure chamber 1004 and this switch may be instructed by the operator of the tool to ignite a detonator 1046. When ignited, detonator 1046 sets off the punch charge 1042, which is selected to create a hole only through the housing 1006 of the setting tool 1000, and not through the casing of the well. Note that by firing the punch charge 1042, not enough pressure is generated inside the pressure chamber 1004 to activate the setting tool as the punch charge is too small. However, the well fluid is allowed to directly enter into the pressure chamber 1004 and actuate the floating piston 1010. If the setting tool is modified as shown in FIG. 10, then the gun string 1040 may be attached to the setting tool directly, as shown in the figure and similar to the embodiment discussed with regard to FIG. 4, or through a traditional sub and a quick change tool, i.e., the setting tool is attached to the quick change tool and the gun string is attached to the sub.

Figure 11:
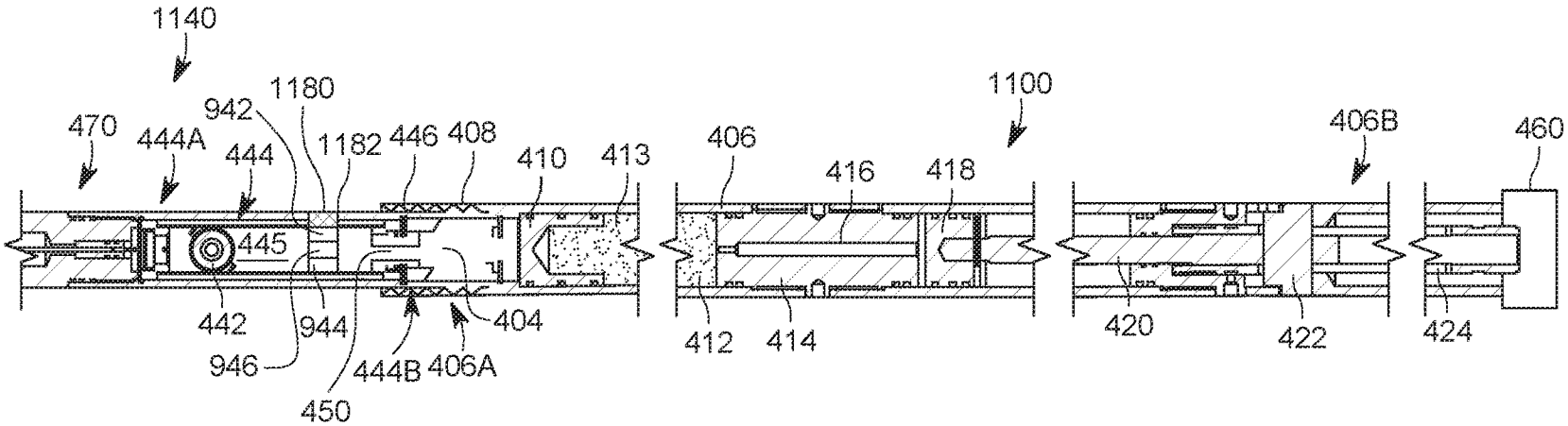
FIG. 11 shows a setting tool attached to a gun string that has a punch charge located next to a plug port for making a hole in a casing of the gun string.

While the embodiments of FIGS. 9 and 10 show a punch charge being located either in the gun string or in the setting tool and being configured to make a hole through the casing of the gun string or through the housing of the setting tool, the embodiment of FIG. 11 shows an implementation in which a port plug 1180 is located in the wall of the casing 444 of the gun string 1140. More specifically, a hole 1182 is made into the wall of the casing 444 and the port plug 1180 covers the hole 1182, so that well fluid is prevented from entering from the well into the interior chamber 445. The port plug 1180 is placed such that the punch charge 942, when fired, would break the port plug so that communication between the inside and outside of the casing 444 is establish and the well fluid is allowed to enter inside the casing 444 and the pressure chamber 404 in the setting tool 1100. In this regard, the punch charge 942 may be located in direct contact with the port plug 1180. Then, control of the setting tool is achieved by increasing the pressure of the well fluid as discussed in the previous methods. The port plug is, in one embodiment, a bursting disk, which is made to break at a given pressure. The pressure may be chosen depending on the characteristics of the well.

Figure 3:
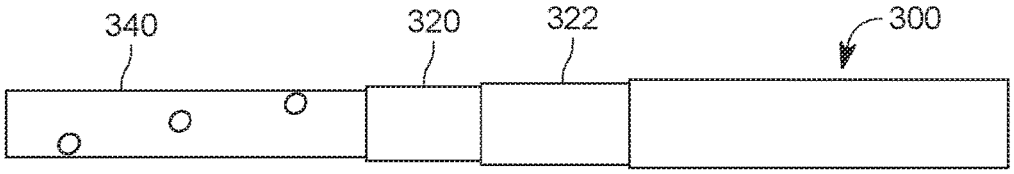
FIG. 3 shows another setting tool that is configured to use the well fluid for being actuated.
Figure 12:
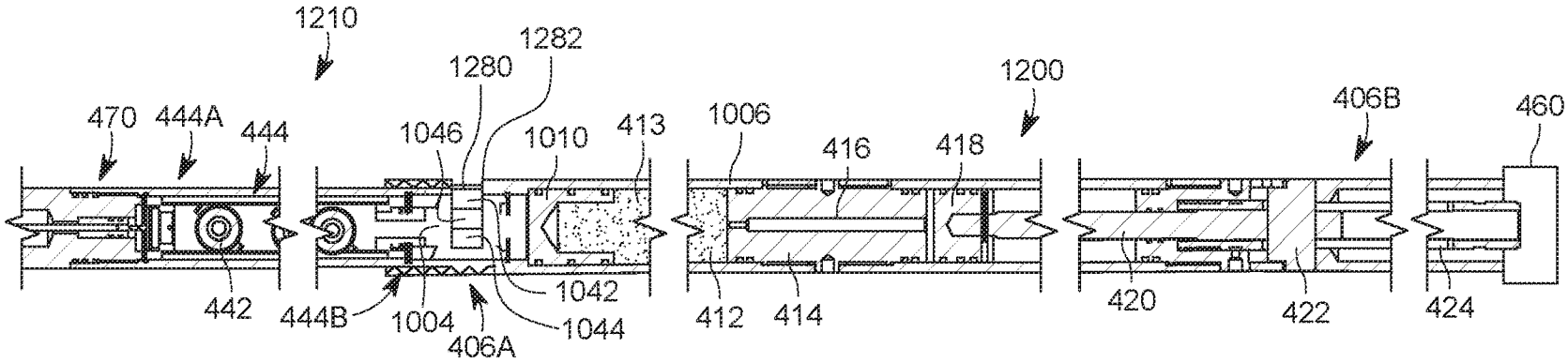
FIG. 12 shows a setting tool having a punch charge located next to a plug port for making a hole in a housing of the setting tool.

FIG. 12 shows another implementation of the hydraulically actuated setting tool 1200, in which a port plug 1280 is formed in a wall of the housing 1006 of the setting tool (to cover a hole 1282 made in the wall) and the punch charge 1042 is located adjacent to the port plug to be able to break the port plug when fired. The switch 1044 and detonator 1046 are located similar to the embodiment illustrated in FIG. 10. For this embodiment, the setting tool may be attached directly to the gun string 1210, as shown in the figure, or it may be attached through a sub and a quick change tool, as illustrated in FIG. 3. For taking control of the setting tool, the switch 1044 is instructed to ignite the detonator 1046, which fires the punch charge 1042. The punch charge 1042 then breaks the port plug 1280, so that the well fluid is allowed to enter through the hole 1282 into the pressure chamber 1004. From here, the actuation of the setting tool follows the methods previously discussed. Note that the hole 1282 is completely sealed by the port plug 1280 before the punch charge is fired.

Figure 13:
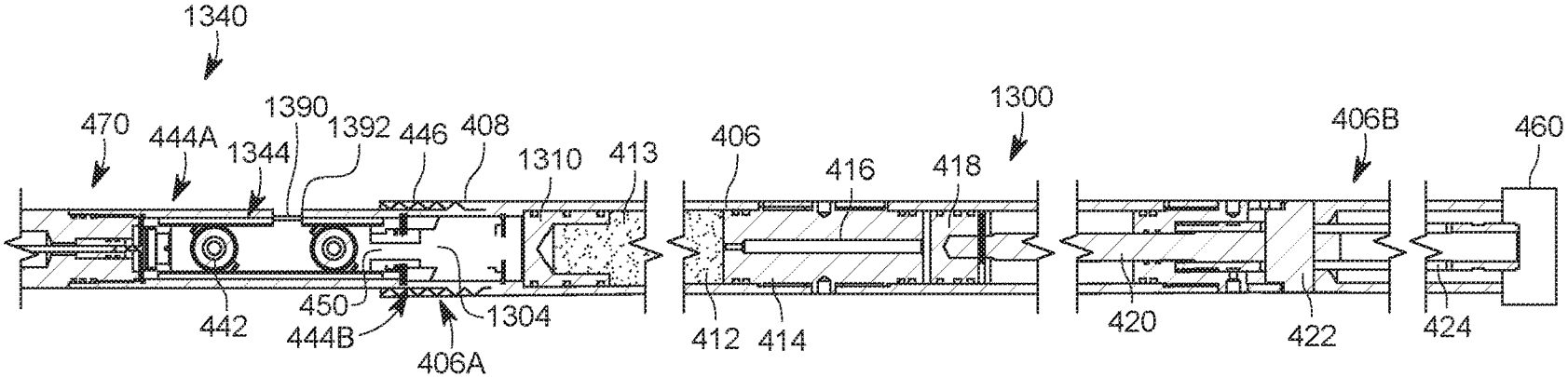
FIG. 13 shows a setting tool attached to a gun string that has a breaking disk for flooding an interior of the gun string.

According to still another embodiment, the hydraulically actuated setting tool may be implemented as illustrated in FIG. 13, to have a rupture disk 1390 located in a hole 1392 formed in a wall of the casing 1344 of a gun string 1340. The rupture disk 1390 is manufactured to withstand a given threshold pressure. If the pressure in the well is increased by the operator of the well beyond the threshold pressure, the rupture disk 1390 will burst, and thus, will allow the well fluid to enter inside the casing 1344. From here, the well fluid moves through the communication passage 450 into the pressure chamber 1304 of the setting tool 1300, and thus, the well fluid acts directly on the floating piston 1310. Then, the setting tool is actuated as discussed in the previous methods. The rupture disk may be made of any material.

Figure 14:
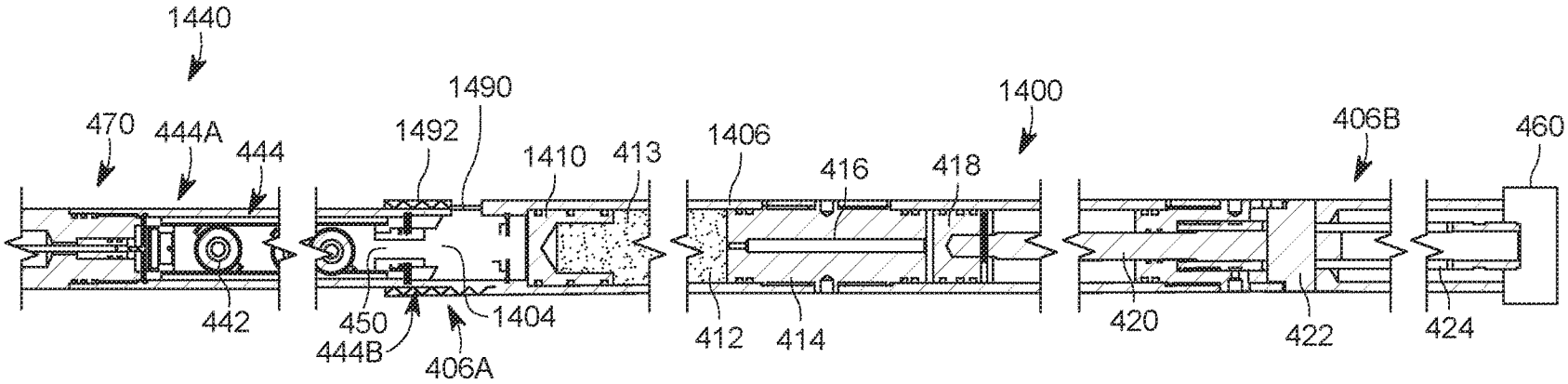
FIG. 14 shows a setting tool having a breaking disk for flooding an interior of the setting tool.

In still another embodiment illustrated in FIG. 14, a rupture disk 1490 is installed in a corresponding hole 1492 formed in a wall of the housing 1406 of the setting tool 1400. For this embodiment, the gun string 1440 may be directly connected to the setting tool as shown in the figure, or through a sub and quick change tool as illustrated in FIG. 3. Similar to the embodiment discussed with regard to FIG. 13, when the operator of the well increases the well pressure, the well fluid breaks the rupture disk 1490 and the well fluid enters directly into the pressure chamber 1404. From here, the well fluid exerts a pressure on a floating piston 1410, which activates the setting tool, as previously discussed in other embodiments.

Figure 15:
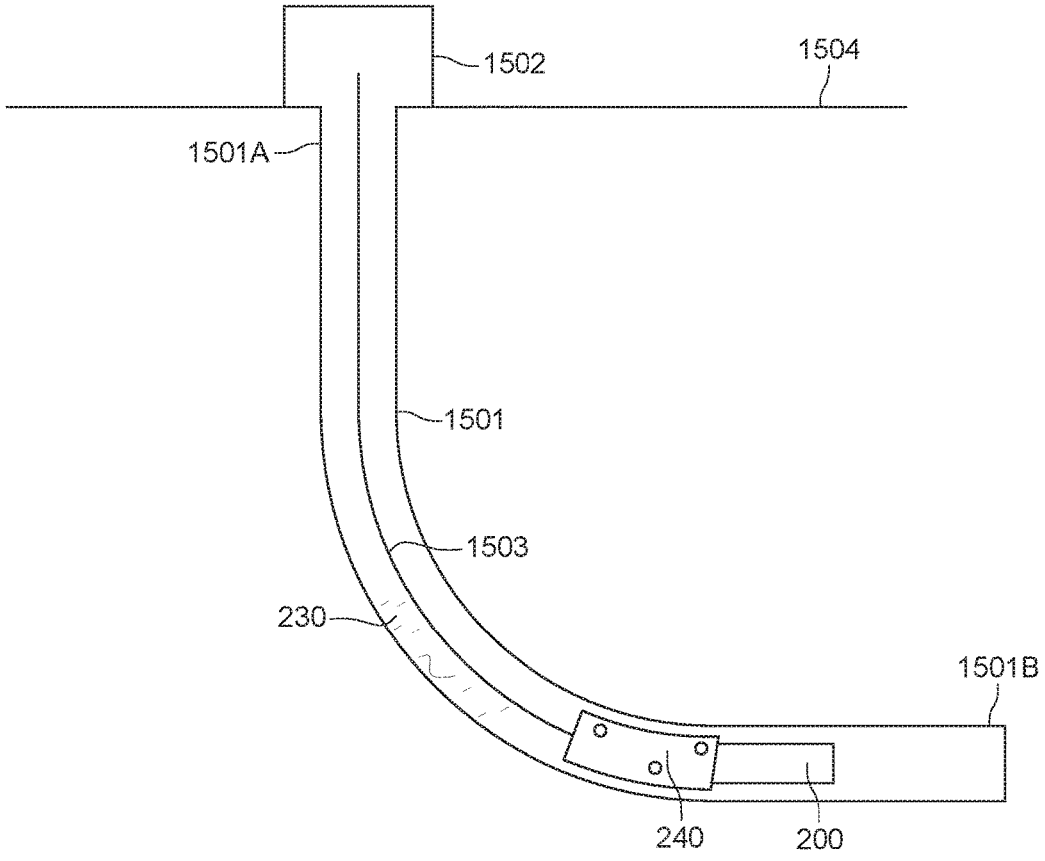
FIG. 15 shows a setting tool attached to a gun string when deployed in a well.

It is noted that the embodiments discussed above rely on the energy provided by the well fluid, i.e., there is no need of an internal gas in the pressure chamber of the setting tool to be pressurized by burning a power charge. In other words, the energy necessary to activate the setting tool is obtained from a hydraulic pressure, which is received from the well, i.e., the hydrostatic pressure of the well, which may be combined or not with the pressure generated by a surface pump 1502, as illustrated in FIG. 15. This means that different from a traditional setting tool, which is actuated by burning a power charge, the setting tool in one or more embodiments in this application is actuated with energy obtained from the hydrostatic pressure of the well, and this pressure is communicated to the setting tool by making a communication path between the well and the interior of the setting tool, either directly into the setting tool, or into the gun string and then into the setting tool. The surface pump 1502 is placed at the surface 1504 at the head 1501A of the well 1501. A wireline 1503 may be used to lower the gun string 240 into the well. The gun string 240 is shown being directly attached to the setting tool 200, similar to the embodiment shown in FIG. 2. The assembly is shown being located in a horizontal portion of the well, next to a toe 1501B of the well. However, as discussed in the embodiment of FIG. 3, the gun string 240 may be attached trough a sub and a quick release tool to the setting tool 200. By controlling the pressure of the well fluid 230 with the pump 1502, or with any other device used in the art, the operator of the well can control the pressure inside the setting tool after fluid communication is achieved between the inside and outside of the setting tool. In this way, the setting tool may be actuated. In other words, the setting tool may be considered to include a communication element, which is configured to make the outside of the housing of the setting tool to communicate with the inside of the housing, so that the well fluids can act directly on the floating piston 410. This communication element is the opening 450 to the gun as illustrated in FIG. 9, or the charge punch 1042 in FIG. 10, or the port plug 1280 in FIG. 12, or the rupture disk 1490 in FIG. 14.

Figure 16:
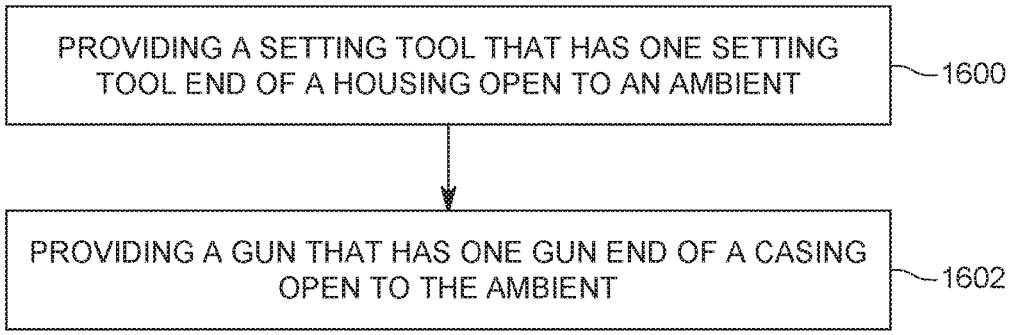
FIG. 16 is a flowchart of a method for attaching one of the setting tools noted above to a gun string.

A method for manufacturing an assembly 400, 440 to be used for setting an auxiliary tool in a well is now discussed with regard to FIG. 16. The method includes a step 1600 of providing a setting tool 400 that has one setting tool end 406A of a housing 406 open to an ambient, and a step 1602 of providing a gun 440 that has one gun end 444B of a casing 444 open to the ambient. The gun end is configured to be directly attached to the setting tool end so that there is internal fluid communication between an inside of the gun 440 and an inside of the setting tool 400.

Figure 17:
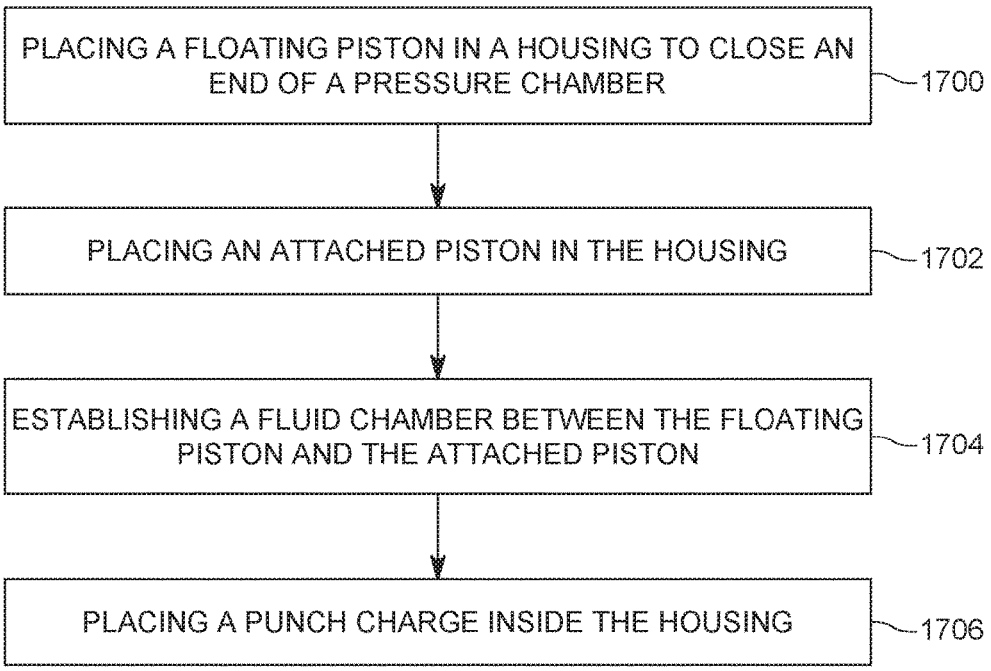
FIG. 17 is a flowchart of a method of manufacturing one of the setting tools noted above.

A method for manufacturing a setting tool 1000 or 1200 for setting an auxiliary tool in a well is now discussed with regard to FIG. 17. The method includes a step 1700 of placing a floating piston 1010 in a housing 1006 to close an end of a pressure chamber 1004, the housing 1006 being configured to prevent a well fluid from entering inside the pressure chamber, a step 1702 of placing an attached piston 418 in the housing, wherein the attached piston is configured to actuate the auxiliary tool, a step 1704 of establishing a fluid chamber 412 between the floating piston 1010 and the attached piston 418, wherein the fluid chamber 412 holds a fluid 413, and a step 1706 of placing a punch charge 1042 inside the housing 1006, the punch charge being configured to make a hole in a wall of the housing when fired so that the well fluid enters inside the pressure chamber 1004.

Figure 18:
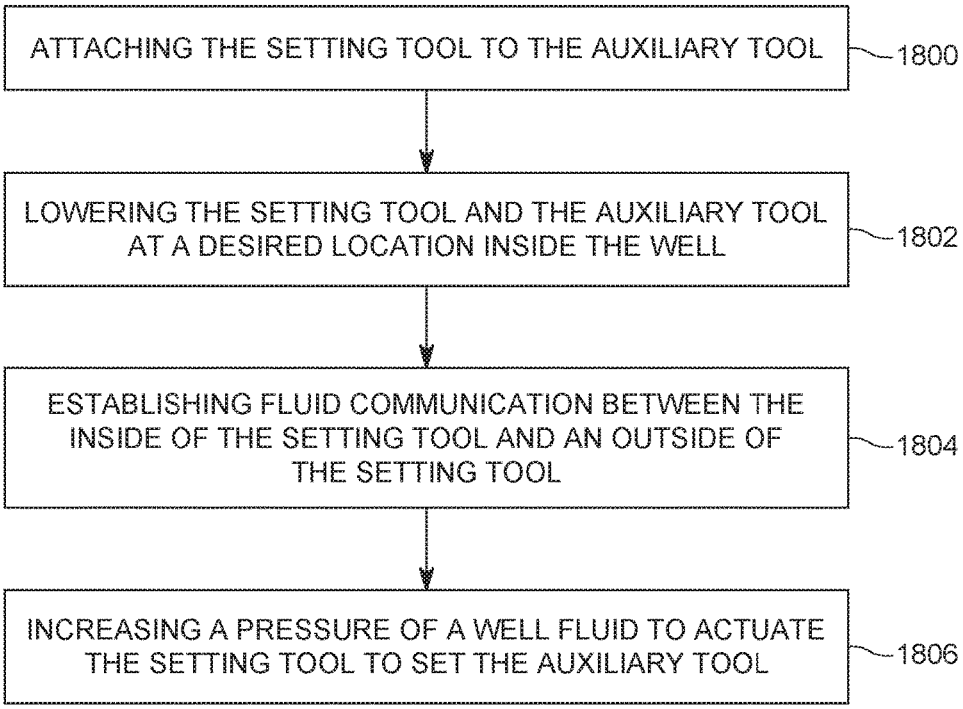
FIG. 18 is a flowchart of a method for actuating one of the setting tools noted above.

A method for setting an auxiliary tool in a well with a setting tool is now discussed with regard to FIG. 18. The method includes a step 1800 of attaching the setting tool to the auxiliary tool, a step 1802 of lowering the setting tool and the auxiliary tool at a desired location inside the well, a step 1804 of establishing fluid communication between the inside of the setting tool and an outside of the setting tool, and a step 1806 of increasing a pressure of a well fluid to actuate the setting tool to set the auxiliary tool.

In one embodiment, an assembly (400, 440) for setting an auxiliary tool in a well includes a setting tool (400); and a gun (440) directly attached to the setting tool (400) so that there is internal fluid communication between an inside of the gun (440) and an inside of the setting tool (400). The assembly may further include a communication passage (450) that allows a fluid from the gun to move inside the setting tool. The gun may have a casing (444) which includes an interior chamber (445), and the interior chamber is sealed from a well fluid. The setting tool may have a housing (406) having a pressure chamber (404), which is sealed from the well fluid. The communication passage may fluidly links the interior chamber of the gun to the pressure chamber of the setting tool. The setting tool may include a floating piston (410) located at one end of the pressure chamber; and an attached piston (418) that defines together with the floating piston a pressure chamber. The pressure chamber may be filled with oil. The gun may be a gun string that includes plural shaped charges, wherein a shaped charge is configured to make a hole in a casing of the gun and also in a casing of the well. Alternatively, or in addition, the gun may be a single gun that includes a punch charge (752), wherein the punch charge is configured to make a hole in a casing of the gun but not in a casing of the well. In one application, the gun may be a gun string including plural shaped charges, and the gun further includes a punch charge (942) located in an interior chamber and configured to make a hole through a casing of the gun but not through a casing of the well. The punch charge may be wired to be fired independent of the plural shaped charges of the gun string. The gun string may include a port plug (1180) formed in a wall of the casing of the gun, to cover a hole formed in the wall, and to prevent a well fluid from the well to enter inside the interior chamber, wherein the punch charge is located adjacent to and behind the port plug and the punch charge and the port plug are selected so that the punch charge breaks the port plug when the punch charge is fired. The gun may be a gun string including plural shaped charges, and the gun further includes a disk (1390) located in a hole (1392) formed in a wall of a casing of the gun string so that well fluid from the well does not enter inside the casing through the hole. The disk may be configured to break when a pressure of the well fluid is above a threshold pressure and the well fluid enters inside the casing of the gun and the inside of the setting tool.

In still another embodiment, there is a method for manufacturing an assembly (400, 440) to be used for setting an auxiliary tool in a well. The method includes a step of providing (1600) a setting tool (400) that has a setting tool end (406A) of a housing (406) open to an ambient; and a step of providing (1602) a gun (440) that has a gun end (444B) of a casing (444) open to the ambient. The gun end is configured to be directly attached to the setting tool end so that there is internal fluid communication between an inside of the gun (440) and an inside of the setting tool (400). The method may further include establishing a communication passage (450) between the setting tool end and the gun end to allow a fluid from the gun to move inside the setting tool. The casing (444) of the gun includes an interior chamber (445), and the interior chamber is sealed from a well fluid, and the housing (406) of the setting tool has a pressure chamber (404) that is sealed from the well fluid. In one application, the communication passage fluidly links the interior chamber of the gun to the pressure chamber of the setting tool. The gun may be a gun string that includes plural shaped charges, and a shaped charge is configured to create a hole in the casing of the gun and also in a casing of the well. The gun may be a single gun that includes a punch charge, and the punch charge is configured to create a hole in a casing of the gun but not in a casing of the well. Alternatively, the gun is a gun string including plural shaped charges, and the method further includes a step of placing a punch charge (942) in an interior chamber of the gun to create a hole through a casing of the gun, but not through a casing of the well; and a step of wiring the punch charge to be fired independent of the plural shaped charges of the gun string. The method may further include forming a port plug (1180) in a wall of the casing of the gun to cover a hole formed in the wall and to prevent a well fluid from the well to enter inside the interior chamber, wherein the punch charge is located adjacent to and behind the port plug and the punch charge and the port plug are selected so that the punch charge breaks the port plug when the punch charge is fired. The gun may also be a gun string including plural shaped charges, and the method further includes placing a disk (1390) in a hole (1392) formed in a wall of the casing of the gun string so that well fluid from the well does not enter inside the casing through the hole. The method may also includes a step of increasing a pressure of the well fluid above a threshold pressure to break the disk so that the well fluid enters inside the casing of the gun and the inside of the setting tool.

In yet another embodiment, there is a method of using an assembly (400, 440) for setting an auxiliary tool in a well, the assembly method including a step of directly attaching (600) a setting tool (400) to a gun (440) so that there is internal fluid communication between an inside of the gun (440) and an inside of the setting tool (400); a step of attaching (602) the auxiliary tool to the setting tool (400); a step of lowering (604) the assembly and the auxiliary tool into the well; a step of establishing (606) fluid communication between the inside of the setting tool and an outside of the setting tool; and a step of increasing (608) a pressure of a well fluid to actuate the setting tool.

The disclosed embodiments provide methods and systems for hydraulically actuating a setting tool while located in a well. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A hydraulically activated setting tool for setting an auxiliary tool in a well, the setting tool comprising:

a housing that prevents a well fluid from entering inside the housing;

a floating piston placed inside the housing and closing an end of a pressure chamber;

an attached piston placed inside the housing and configured to actuate the auxiliary tool;

a fluid chamber located between the floating piston and the attached piston, wherein the fluid chamber holds a fluid; and a communication element configured to establish a fluid communication between an outside and an inside of the housing, wherein the fluid communication makes a well fluid in the well to directly act on the floating piston.

2. The setting tool of claim 1, wherein the communication element is a punch charge located inside the housing and configured to create a hole in a wall of the housing when fired so that the well fluid enters inside the pressure chamber.

3. The setting tool of claim 2, wherein the punch charge is located inside the pressure chamber.

4. The setting tool of claim 3, wherein a gas pressure generated by the punch charge, when fired inside the pressure chamber, is not enough to actuate the setting tool.

5. The setting tool of claim 2, further comprising:

a switch; and a detonator, wherein the switch is configured to activate the detonator and the detonator is configured to fire the punch charge to create the hole.

6. The setting tool of claim 5, wherein the switch and the detonator are located in the pressure chamber.

7. The setting tool of claim 1, wherein the pressure chamber is filled with air.

8. The setting tool of claim 1, wherein the communication element includes a port plug formed in a wall of the housing of the setting tool to cover a hole formed in the wall, wherein the port plug prevents a well fluid from the well to enter inside the pressure chamber, and a punch charge located adjacent to and behind the port plug, the punch charge and the port plug being selected so that the punch charge breaks the port plug when the punch charge is fired.

9. The setting tool of claim 8, wherein the hole is located in the pressure chamber.

10. The setting tool of claim 1, wherein the communication element includes a disk located in a hole formed in a wall of the housing of the setting tool so that well fluid from the well does not enter inside the housing through the hole.

11. The setting tool of claim 10, wherein the hole is located in the pressure chamber.

12. The setting tool of claim 10, wherein the disk is configured to break when a pressure of the well fluid is above a threshold pressure and the well fluid enters inside the pressure chamber of the setting tool to actuate the floating piston.

13. The setting tool of claim 1, wherein the communication element includes a direct communication passage formed between an interior chamber of a gun string and the pressure chamber of the setting tool.

14. A method for manufacturing a setting tool for setting an auxiliary tool in a well, the method comprising:

placing a floating piston in a housing to close an end of a pressure chamber, the housing being configured to prevent a well fluid from entering inside the pressure chamber;

placing an attached piston in the housing, wherein the attached piston is configured to actuate the auxiliary tool;

establishing a fluid chamber between the floating piston and the attached piston, wherein the fluid chamber holds a fluid; and placing a communication element inside the housing, the communication element being configured to establish a fluid communication between an outside and an inside of the housing.

15. The method of claim 14, wherein the communication element is a punch charge, and the method further comprises:

firing the punch charge to create a hole in a wall of the housing so that the well fluid enters inside the pressure chamber.

16. The method of claim 15, wherein the punch charge is located inside the pressure chamber.

17. The method of claim 15, wherein a gas pressure generated by the punch charge, when detonated inside the pressure chamber, is not enough to actuate the setting tool.

18. The method of claim 15, further comprising:

placing a switch inside the housing; and placing a detonator inside the housing, wherein the switch is configured to activate the detonator and the detonator is configured to fire the punch charge to create the hole.

19. The method of claim 18, further comprising:

placing the switch and detonator inside the pressure chamber.

20. The method of claim 14, wherein the communication element is a port plug located in a wall of the housing of the setting tool, the port plug covers a hole formed in the wall, and the port plug prevents a well fluid from the well to enter inside the pressure chamber, the method further comprising:

locating a punch charge adjacent to and behind the port plug, and firing the punch charge to break the port plug.

21. The method of claim 20, wherein the hole is located in the pressure chamber.

22. The method of claim 14, wherein the communication element is a disk, and the method further comprises:

placing the disk in a hole formed in a wall of the housing of the setting tool, so that well fluid from the well does not enter inside the housing through the hole.

23. The method of claim 22, wherein the hole is located in the pressure chamber.

24. The method of claim 22, further comprising:

breaking the disk by increasing a pressure of the well fluid above a threshold pressure so that the well fluid enters inside the pressure chamber of the setting tool to actuate the floating piston.

25. A method for setting an auxiliary tool in a well with a setting tool, the method comprising:

attaching the setting tool to the auxiliary tool;

lowering the setting tool and the auxiliary tool to a desired location inside the well;

establishing fluid communication between the inside of the setting tool and an outside of the setting tool by creating a hole in a wall of the housing with a punch charge located inside the housing so that the well fluid enters inside a pressure chamber; and increasing a pressure of a well fluid to actuate the setting tool to set the auxiliary tool.

26. The method of claim 25, further comprising:

placing the punch charge inside the pressure chamber.

27. The method of claim 25, wherein a gas pressure generated by the punch charge, when detonated inside the pressure chamber, is not enough to actuate the setting tool.

28. The method of claim 25, further comprising:

firing the punch charge to break a port plug formed in a wall of the housing of the setting tool, wherein the port plug covers a hole formed in the wall and prevents a well fluid from the well to enter inside the pressure chamber.

29. The method of claim 28, further comprising:

placing the punch charge behind the port plug, and selecting the punch charge and the port plug so that the punch charge breaks the port plug when the punch charge is fired.

* * * * *